US005660710A

United States Patent [19]

Sivilotti

[11] Patent Number: 5,660,710

[45] Date of Patent: Aug. 26, 1997

[54] METHOD AND APPARATUS FOR ELECTROLYZING LIGHT METALS

[76] Inventor: Olivo Sivilotti, 26 Stormont Avenue, Kingston, Ontario, Canada, K7M 1P1

[21] Appl. No.: 594,761

[22] Filed: Jan. 31, 1996

[51] Int. Cl.[6] ..... C25C 3/00; C25C 7/00

[52] U.S. Cl. ..... 205/367; 204/245; 204/246; 204/247; 204/241

[58] Field of Search ..... 204/241, 243 R, 204/244–247; 205/367, 404, 372, 407–408, 405, 409

[56] References Cited

U.S. PATENT DOCUMENTS

| | | | |
|---|---|---|---|
| 1,501,756 | 5/1924 | Downs . | |
| 2,876,181 | 3/1959 | Wood et al. . | |
| 2,944,950 | 12/1960 | Hayes . | |
| 3,085,969 | 4/1963 | Motock . | |
| 3,335,076 | 8/1967 | Burkhardt | 204/245 X |
| 3,396,094 | 8/1968 | Sivilotti et al. . | |
| 3,418,223 | 12/1968 | Love . | |
| 3,502,553 | 3/1970 | Gruber | 204/245 X |
| 3,962,064 | 6/1976 | Brut et al. . | |
| 4,055,474 | 10/1977 | Sivilotti . | |
| 4,420,381 | 12/1983 | Sivilotti et al. . | |
| 4,514,269 | 4/1985 | Sivilotti . | |
| 4,518,745 | 5/1985 | Engelhardt et al. . | |
| 4,604,177 | 8/1986 | Sivilotti . | |
| 4,617,098 | 10/1986 | Verdier et al. . | |
| 4,724,055 | 2/1988 | Le Roux et al. . | |
| 4,740,279 | 4/1988 | Muller et al. . | |
| 4,744,876 | 5/1988 | Bernard et al. | 204/245 |
| 4,960,501 | 10/1990 | Sivilotti . | |
| 5,417,815 | 5/1995 | Robinson et al. . | |

*Primary Examiner*—Donald R. Valentine

*Attorney, Agent, or Firm*—Dickinson, Wright, Moon, Van Dusen & Freeman

[57] ABSTRACT

The present invention provides a new and useful process for the production of a molten metal by electrolysis in an electrolytic cell having an electrolysis compartment, a metal recovery compartment, and a partition separating upper parts of said compartments, said process comprising: electrolysing in said electrolysis compartment an electrolyte containing a fused salt of said metal said salt being of greater density than said metal; continuously withdrawing the product metal mixed with said electrolyte in a stream from said electrolysis compartment to a top part of said metal recovery compartment; allowing said metal to form in said metal recovery compartment a pad floating on said electrolyte; maintaining said pad out of contact with said partition; and recovering said pad.

33 Claims, 5 Drawing Sheets

METHOD AND APPARATUS FOR ELECTROLYZING LIGHT METALS

FIELD OF THE INVENTION

This invention relates to improved processes and apparatus for the production of molten metals by electrolysis of their fused salts where the metal is lighter than the electrolyte. More particularly, the invention relates to improved method and apparatus to collect molten metals such as lithium, magnesium, or sodium in electrolytic cells of monopolar and multipolar design.

BACKGROUND OF THE INVENTION

All electrolytic cells that are used to commercially produce lithium, magnesium or sodium utilize an electrolysis compartment where the electrolysis gas is collected and a metal recovery compartment in which the metal collects and is stored between tappings. Between the two compartments is a partition. As a common feature, this partition is usually immersed deep in the electrolyte to effect good separation of the electrolysis gas and long storage of the metal produced. This partition, sometimes called a curtain wall or semi-wall, is a critical component of the cell due to the reactivity of the gas and/or the metal and the consequent need to maintain their separation, but it is usually one of the components that limit the operating life of a cell due to wear and cracking. The chemical wear of the curtain wall in contact with the metal may be responsible for some loss of product metal purity, and cracks in the curtain wall result in leaks of metal and air into the electrolysis gas.

PRIOR ART

U.S. Pat. No. 1,501,756, issued Jul. 15, 1924 to Downs, describes a process commercially used to produce sodium from sodium chloride. The process uses for the collection of the molten sodium an upper reservoir which is separate from the electrolysis cell itself.

U.S. Pat. No. 3,396,094, issued Aug. 6, 1968 to Sivilotti et al., describes an electrolytic magnesium cell that is provided with a metal collecting reservoir, located in the metal compartment and almost wholly submersed in the electrolyte. The reservoir consists of an inverted box of steel along the partition above openings through the curtain wall. The reservoir is open along its bottom to receive the metal that comes through the openings through the curtain wall. This metal collection arrangement was superior to the prior art, where the metal was allowed to float freely on the surface of the electrolyte. It allowed the cell to operate with the electrolyte temperature near the melting point of the metal, which resulted in substantial improvement of the current efficiency of the cell. The metal had to be maintained molten to be tapped out of the cell by conventional siphon means, and the fact that the metal was maintained under the surface of the electrolyte equalized the two temperatures without need of supplementary heating means. Relatively large quantities of metal were collected and the need for undue frequency of tapping was avoided.

It was subsequently found that oxidation of the residual floating metal that escaped collection into the reservoir and hydrolysis of the electrolyte were detrimental to the operation of the cell. Sludge formation, short cell life and upsets in current efficiency were still experienced.

A fully enclosed cell provided with an insulating cover, with an inert gas blanket and with internal temperature control means, was developed as described in U.S. Pat. No. 4,420,381. The heat exchanger had to be well insulated where it passed through the floating metal pad in order to avoid premature freezing of the metal.

The design of U.S. Pat. No. 4,420,381 was an improvement over the previous art and has been used with other more recent improvements in cell design. These improvements are related to the use of new electrode geometries, in particular those of multipolar design, that substantially increase cell productivity and decrease unit energy consumption. These improved cells are described in U.S. Pat. Nos. 4,055,474; 4,514,269; 4,518,745; 4,604,177 and 4,960,501, which are incorporated herein by reference. These cells require an even tighter control of the temperature and of the oxidation reactions. Also, they are producing at a high rate so that the volume of metal to be stored in the metal compartment between tappings is very large. Additionally, for good current efficiency, the multipolar cells require an almost constant level in the electrolysis compartment. This can be obtained by feeding the cells continuously in response to level sensing means, or by regulating the supply of inert gas to and from a submersed open-bottom reservoir, to compensate for liquid volume changes when feeding and tapping are carried out intermittently.

In the cell described in U.S. Pat. No. 4,518,745 the electrolyte circulation towards the metal compartment occurs sideways in the planes of the inter-electrode spaces and over a weir, located inside the electrolysis compartment, downstream from the electrodes and upstream from the curtain wall. The electrolyte/metal mixture flows over the weir so that the level above the electrodes remains almost constant. However, the turbulence downstream from the weir entrains residual gas within the electrolyte flowing into the metal compartment. Also, the turbulence hinders coalescence of the metal that would help its rising towards the floating metal pad.

Coalescence could be a significant factor to improve the current efficiency of multipolar cells, as it is believed that droplets which are smaller than a critical size and are recirculated in the electrolysis compartment are consumed by back reactions in the inter-electrode spaces (see Sivilotti O.G., *Operating Performance of the Alcan Multipolar Magnesium Cell, Light Metals,* 117th AIME Annual Meeting, Phoenix, 1988). The critical size of the metal droplets depends on the degree of turbulence and on the path of the circulating electrolyte. Therefore, the geometry of the metal compartment where the metal separates by upwards settling is very important to obtain high current efficiency.

U.S. Pat. No. 5,417,815, issued May 23, 1995 to Robinson et al., describes the prior art for apparatus and methods to produce lithium metal from molten mixtures of lithium chloride and other metal chlorides. The patent describes a liquid metal skimmer based on the use of mechanical propellers in a draft tube. Devices based on mechanical moving parts are difficult to maintain in continuous reliable operation because of the high-temperature molten-salt environment.

While satisfactory operation has been obtained with cells of the prior art, the present invention is designed to obtain significant improvements in such cells and in their method of operation. The main objectives are a better current efficiency and improved yield and recovery of purer metals, as well as greater convenience in the collection and removal of the metal. Cheaper construction and longer operating life result in lower capital costs and lower maintenance expenses.

SUMMARY OF THE INVENTION

It is an object of the present invention to provide a process to electrolytically produce at high current efficiency lithium, magnesium, sodium and other molten metal products that are lighter than the electrolyte.

Another object of the invention is to provide a process to electrolytically produce reactive light metals of high purity.

A further object of the invention is to provide a method for efficiently separating a light metal from an electrolyte stream and for facilitating its tapping at infrequent intervals.

A still further objective of the invention is to provide an electrolytic cell of long life and of cost effective construction for the production of metals lighter than the electrolyte.

Thus in one embodiment the invention provides a process for the production of a molten metal by electrolysis in an electrolytic cell having an electrolysis compartment, a metal recovery compartment, and a partition separating upper parts of said compartments, said process comprising: electrolysing in said electrolysis compartment an electrolyte containing a fused salt of said metal and being of greater density than said metal; continuously withdrawing the product metal mixed with said electrolyte in a stream from said electrolysis compartment to a top part of said metal recovery compartment; allowing said metal to form in said metal recovery compartment a pad floating on said electrolyte; maintaining said pad out of contact with said partition; and recovering said pad.

In a further embodiment the invention provides an electrolytic cell comprising an electrolysis compartment; a metal recovery compartment; and a first partition wall separating a top part of said electrolysis compartment from a top part of said recovery compartment and extending slightly below a normal operating level of electrolyte in said cell when said cell is in operation.

BRIEF DESCRIPTION OF THE DRAWINGS

These and other advantages of the invention will become apparent upon reading the following detailed description and upon referring to the drawings in which.

Figure 1:
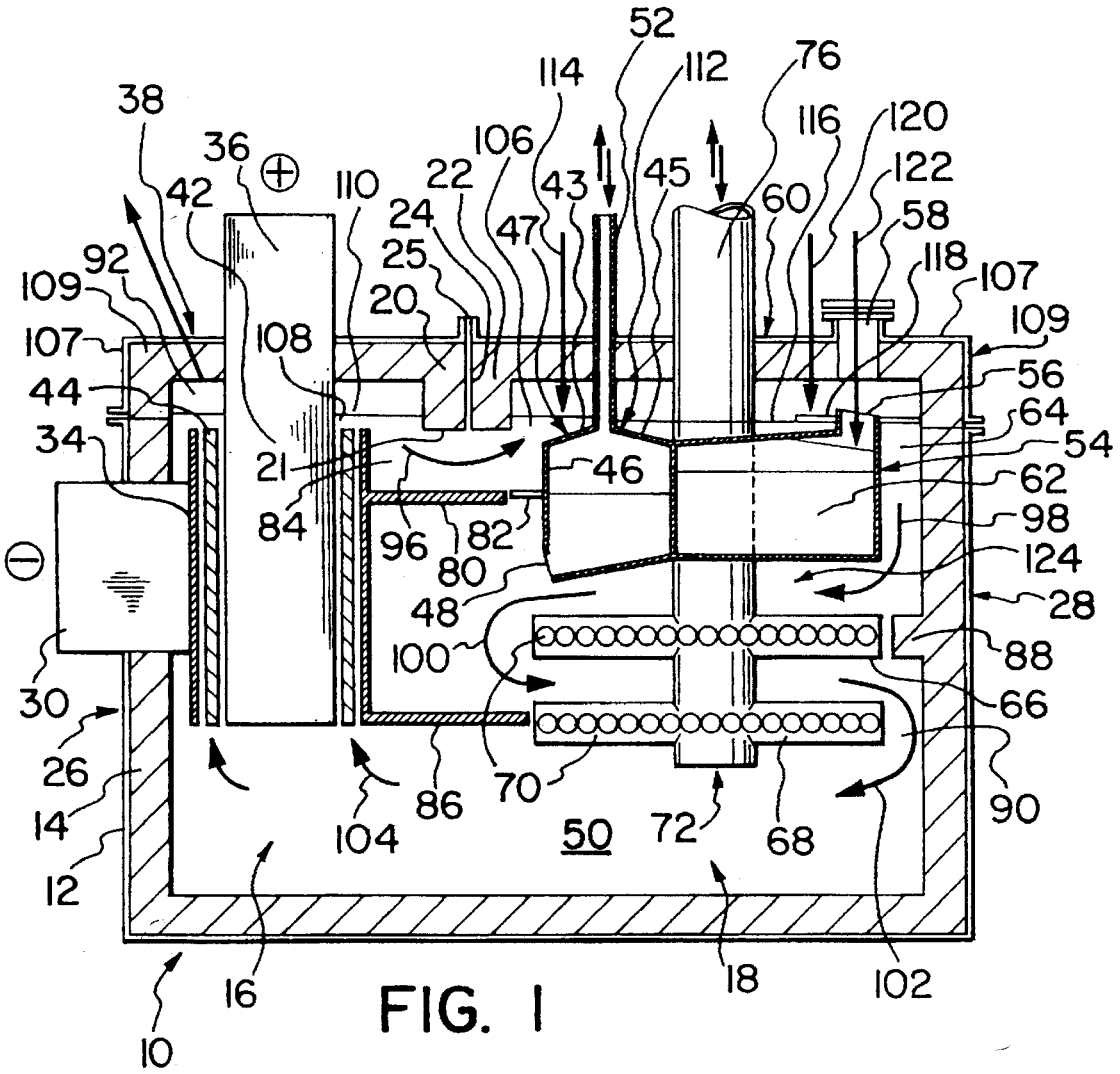
FIG. 1 is a schematic vertical cross-sectional view of an apparatus according to the invention.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

As is evident in the prior art, and in any event to those skilled in the art, the invention is in the context of electrolytic cells which are divided into electrolysis and metal recovery compartments separated by a partition or curtain wall. When the cell is in operation a natural circulation is set up brought about by the liberation of gas in small inter-electrode spaces. As the gas rises, it functions as a pump to set up circulation within the cell. Various means have been used to direct the circulating stream along the upper part of the cell from the electrolysis compartment to the metal recovery compartment and hence downward toward the lower part of the metal recovery compartment and back to the lower part of the electrolysis compartment under the electrodes. In the metal recovery compartment a floating metal pad is formed and is tapped, generally on an intermittent basis. At an appropriate point in the cycle the cell is fed to enrich the electrolyte.

The invention can be embodied by many configurations that meet the required criteria. Those described below are preferred but are by no means the only workable embodiments. The two general criteria required to obtain current efficiencies that are as high as, or close to, those obtainable in electrolytic cells that collect the metal at the cathode and keep it separate from the electrolysis gas that is generated at the anode (as for example U.S. Pat. No. 3,396,094) are, first, that the metal droplets that are released in the inter-electrode space and are entrained by the circulating electrolyte spend the shortest time in the inter-electrode space and, second, that the droplets separate in the metal compartment regardless of their small size. To meet the first criterion the electrolyte is made to circulate as fast as possible and to meet the second criterion, notwithstanding the fast electrolyte flow, means are to be provided to improve coalescence and separation of metal droplets in the metal compartment, so that the electrolyte returning to the electrolysis compartment is as free of metal droplets as possible.

To meet the other objectives of the invention, the separated metal must be maintained out of contact with the refractory walls as much as possible to prevent reaction with the latter and consequent contamination of the metal. This is to be obtained notwithstanding the desirability, for efficient operation, of tapping as infrequently as possible the metal produced.

The fact that the reaction between the refractory walls and the metal is prevented and the fact that the electrolysis and metal compartments are sealed to eliminate metal oxidation and electrolyte hydrolysis are requirements to obtain high current efficiency and long cell operating life.

Figure 2:
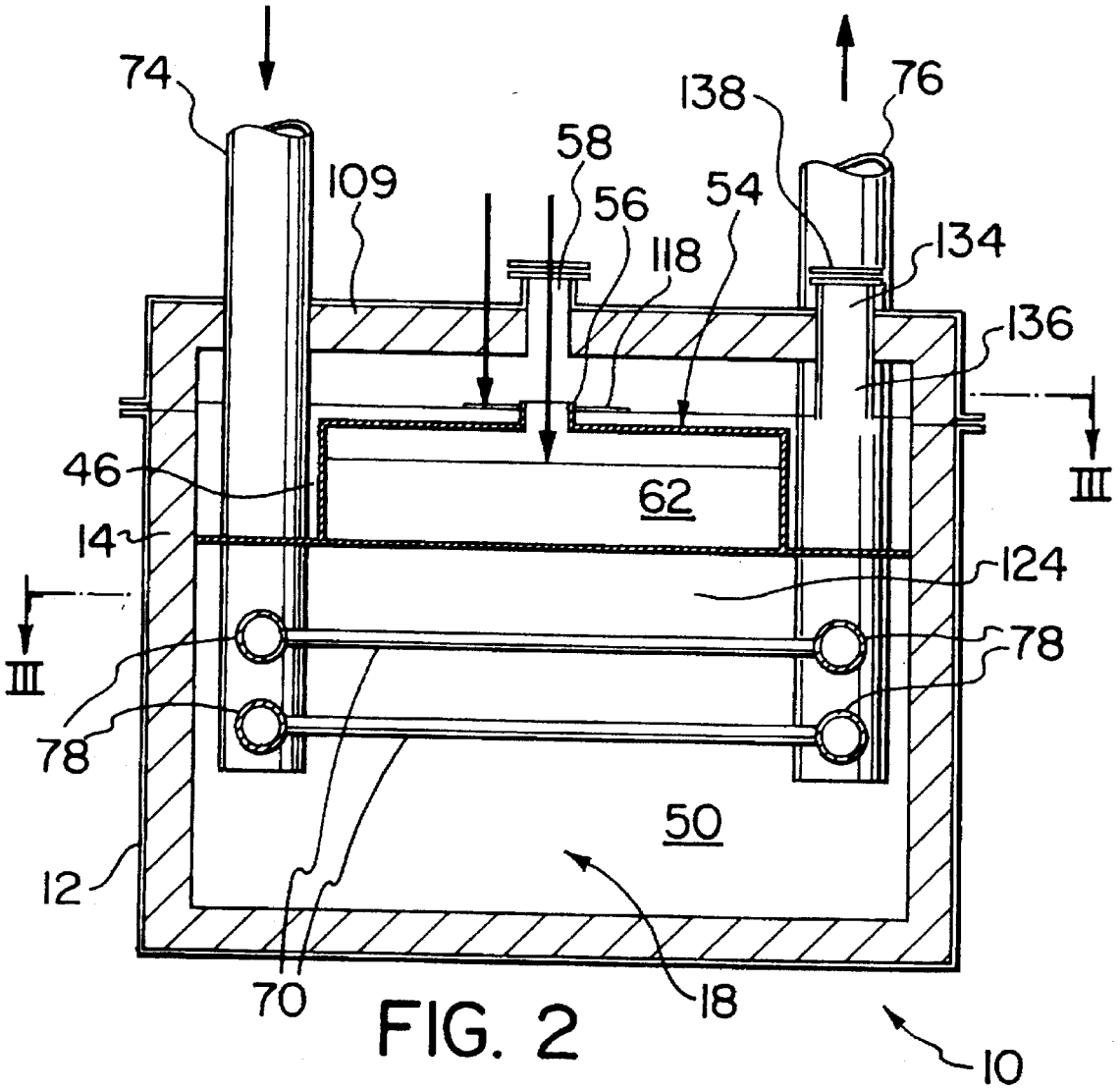
FIG. 2 is a schematic vertical cross-sectional view of the apparatus of FIG. 1.
Figure 3:
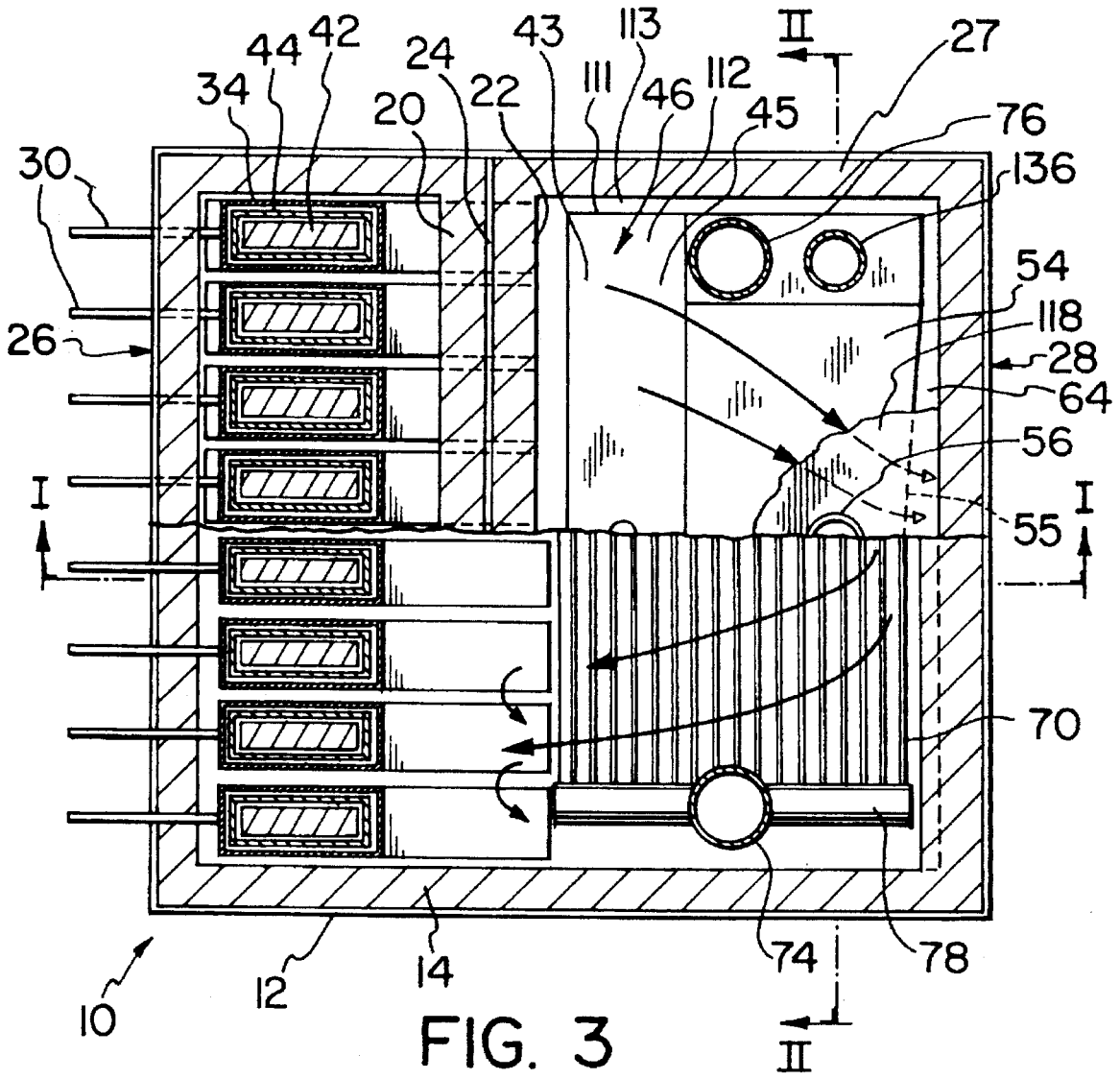
FIG. 3 is a schematic horizontal cross-sectional view of the apparatus of FIG. 1.

With reference to FIGS. 1 to 3, the apparatus illustrated is an electrolytic cell 10 having a structural steel casing 12 lined with a layer of insulating and refractory material 14, suitable to contain a molten salt electrolyte. The cell 10 is divided into an electrolysis compartment 16 and a metal recovery compartment 18, separated by a semi-wall, partition, or curtain wall 20.

In the preferred configuration and for reasons to be discussed below, the cell preferably includes a second partition wall 22 adjacent to partition wall 20 but separated therefrom by the space 24. A conduit 25 leads from space 24 through the top wall of cell 10.

In conventional arrangement, electrolysis compartment 16 is located adjacent back wall 26 and metal recovery compartment 18 is located adjacent front wall 28 of cell 10.

With reference to electrolysis compartment 16, electrical leads 30 pass through back wall 26 and are connected to cathodes 34. Cathodes 34 are normally steel.

Similarly, electrical leads 36 pass through top wall 38 of electrolysis compartment 16 and are connected to anodes 42. Anodes 42 are preferably of graphite.

In a modern multipolar cell, bipolar electrodes 44 are located between anodes 42 and cathodes 34 and each bipolar electrode 44 acts as cathode on one face and anode on the other face, so that the electrolysis process is multiplied by the number of inter-electrode spaces operated within one cell.

With reference to the metal recovery compartment 18, that compartment preferably contains an open-bottom reservoir 46 which is partially open at gate 48 to electrolyte 50. Reservoir 46 includes inlet/outlet 52 for injection or removal of inert gas.

As is discussed later, it is essential to control the level of electrolyte 50 within cell 10. That level can be controlled by injecting gas through inlet/outlet 52 to force liquid from reservoir 46 to raise the level of electrolyte 50 within the cell 10 or gas can be withdrawn from reservoir 46 to permit the flow of electrolyte 50 into reservoir 46 to thereby lower the level of electrolyte 50 in cell 10. The use of an open bottom reservoir for purposes of level control is conventional in the art.

Metal recovery compartment 18 also includes a submerged metal recovery reservoir 54. Reservoir 54 is provided with an entry weir 56, the function of which will be described below, and a port 58 through top wall 60 of metal recovery compartment 18 through which molten metal 62 in reservoir 54 can be tapped.

Metal recovery reservoir 54 is separated from front wall 28 by space 64. Also located within metal recovery compartment 18 are at least two horizontal baffles 66 and 68. In the most preferred configuration, and, as illustrated, the baffles are comprised of the tubes 70 of a heat exchanger 72.

Figure 4:
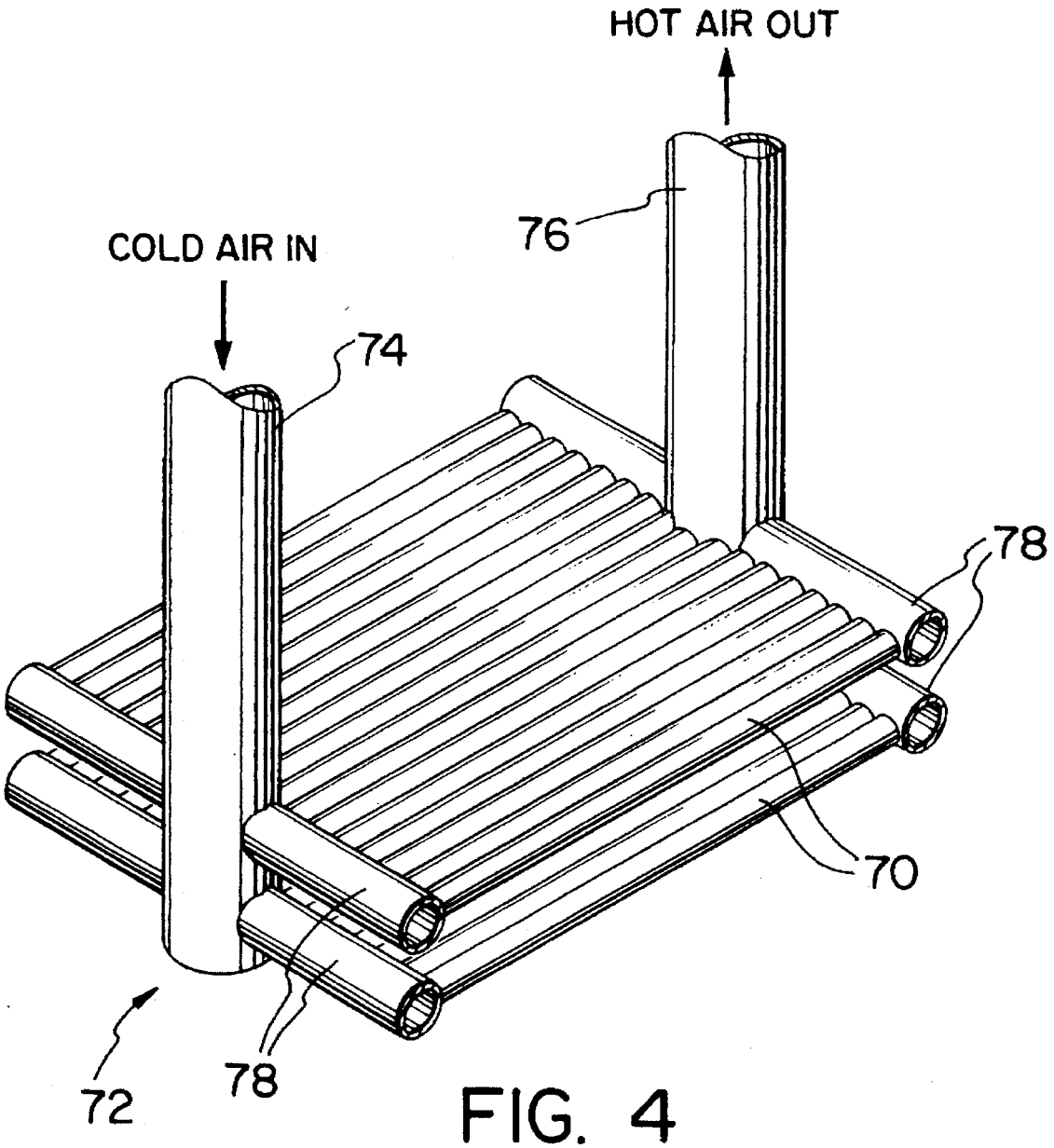
FIG. 4 is a schematic view of a heat exchanger for use in the electrolytic cell of FIGS. 1 to 3.

As illustrated in FIG. 4, heat exchanger 72 comprises inlet 74, outlet 76 and manifolds 78, together with the aforementioned tubes 70.

Reverting back to FIGS. 1 to 3, a horizontal partition 80 extends between cathodes 34 and a wall 82 of reservoir 54 to form a trough 84.

A second horizontal partition 86 extends from cathodes 34 to a position adjacent tubes 70. Adjacent the baffle 66 a short refractory partition 88 extends from front wall 28 to a position adjacent baffle 66. Baffle 68 is separated from front wall 28 by space 90.

The various structural members in the two compartments define flow paths which will be discussed below.

In operation of the cell, electrolysis gas, usually chlorine, is generated on the anodic faces and metal is deposited in liquid form on the cathodic faces. Electrolysis gas in the inter-electrode spaces lifts the electrolyte toward the top of electrolysis compartment 16, where the gas/liquid phases separate. The gas passes into the space 92 at the top of electrolysis compartment 16 and is removed therefrom. The gas is preferably removed under a slightly negative pressure to prevent escape.

The upward movement of the electrolysis gas in the inter-electrode space drives the circulation of the electrolyte through the cell.

Driven by the rising gas, the electrolyte 50 circulates toward the top zone 106 of the metal compartment 18, passing under the semi-wall 20, which is usually, as noted above, of refractory construction to resist the corrosive action of the electrolysis gas. The semi-wall is preferably built as a tight sequence of firebrick blocks anchored to the steel shell 107 of cover 109 of the cell 10, but could also be supported from the floor by refractory or steel piers (not illustrated) or be an arch structure (not illustrated) supported by the sidewalls of cell 10. The refractory material may preferably be made of acid resistant firebrick or of fused alumina or of glass-ceramic material such as PYROCERAM 9606™ cordierite as described in U.S. Pat. No. 5,429,722.

One important aspect of the invention is that the semi-wall 20 does not go deeply into the electrolyte 50, not to unduly impede the circulation of the electrolyte towards the top of the metal compartment, as occurs in the cells of the prior art. One important function of the separating wall in the prior art was to contain the metal accumulating in the metal compartment between tappings. A deep metal pad floating on electrolyte 50 was required also to facilitate tapping by siphon. However, when the metal pad is deep, the liquid metal being lighter than the electrolyte has the tendency to pass through cracks or holes or open joints in the separating wall, and to return to the electrolysis compartment where it back-reacts with the electrolysis gas.

In the present case, as discussed below, a deep metal pad is not formed, and so the only function of the semi-wall of the present invention is to seal the gas zone 106 at the top of the electrolysis compartment 16 where the gas readily separates from the electrolyte due to its much lower density.

To prevent carry-over of the residual gas to the metal compartment by the circulating electrolyte, the second semi-wall 22 can be provided, following the semi-wall 20. A slightly positive pressure of inert gas is maintained in the metal compartment. The residual gas is released against the bottom 21 of semi-wall 20 and makes its way into the space 24 between the two semi-walls. This gas is then vented out together with some inert gas that leaks through the semi-wall 22 (because of cracks or of its natural porosity), making the metal compartment 18 free of electrolysis gas. The second semi-wall 22 can be of the same refractory material, as shown in FIG. 1, or of metallic material, depending on the corrosive conditions and the quantity of residual electrolysis gas prevailing in the space between the semi-walls. Veut conduit 25, if desired, is connected to gas scrubbing apparatus (not shown) designed to absorb the residual electrolysis gas before release to the atmosphere.

To further prevent the carry-over of residual electrolysis gas into the metal compartment by the circulating electrolyte, the liquid velocity under the semi-wall is reduced by the deep trough 84 located along the semi-walls, into which the semi-walls themselves are slightly immersed. With suspended semi-walls that are not supported from the bottom, the velocity of the electrolyte is minimized relative to the velocity in the turbulent zone 108 above the electrodes, as the total width of the cell is made available to the electrolyte flow, and therefore the electrolyte velocity and the gas carry-over is reduced to a minimum. The carry-over of metal droplets, however, is still active, because the small density difference between metal and electrolyte favours the entrainment, and because the metal droplets are still very small as the metal did not have a chance to fully coalesce in the turbulent zone 108 above the electrodes.

The design of the trough 84 for optimum performance of the gas/electrolyte separation and of the electrolyte/metal carry-over functions, could be carried out following the research techniques described in the AIME paper referred to above. The electrolyte flow path that is made possible by the novel geometry of the semi-walls 20/22 and of the trough 84 of this invention affords a reduced turbulence of the electrolyte in this critical zone under the semi-wall and, therefore, an early onset of coalescence of the metal droplets. The other advantageous feature afforded by this aspect of the invention is the fact that the streamlined flow of the electrolyte reaches the very surface of the metal compartment where metal separation coalescence naturally occurs resulting in increased metal collection efficiency.

In the preferred case, for the sake of more reliable sealing and better stability of liquid level 110 in the electrolysis compartment 16 above the electrodes 34/44, is located an overflow weir 112 downstream from the trough 84. The geometry is chosen to reduce the turbulence due to this weir to a minimum. The trade-off is between the advantage of increased reliability of the gas seal and increased control of the bypass current on top of the bipolar electrodes; and the loss of some metal coalescence and separation because of the increased electrolyte velocity over the weir, but this loss can be minimized by round-shaping the cross section of the weir itself, as it is conventionally practiced in overflow weirs used in spillways and in other large-scale water works.

As illustrated in FIGS. 1 and 2, weir 112 is conveniently formed as the top wall 47 of reservoir 46. The upstream and downstream sides 43 and 45 respectively of top wall 47 can be individually profiled to promote smooth flow up to and over the weir 46.

The top of weir 112 may be typically 0 to 2 inches above the level of the bottom 21 of partition walls 20/22. The concern is that the electrolyte level behind the weir be such as to maintain bottom 21 of partition walls 20/22 submerged to effect a good seal between compartments 16 and 18 above the electrolyte.

The electrolyte flow over the weir 112 is preferentially stronger at the two ends of the trough to effect a flow from the centre to the ends of the trough and a sweeping flow pattern, past the weir, towards the centre of the free surface of the electrolyte in the front compartment. The weir can be profiled with a higher central section sloped toward lower ends, to achieve this objective. Also the spaces 113 (FIG. 3) between the ends 111 of the weir 112 and the side walls 27 of the cell 10 favour the flow of additional electrolyte at the two sides of the metal compartment 18.

In a preferred configuration the forward face 55 of recovery reservoir 54 is somewhat concave toward weir 56 so that space 64 is somewhat greater in that area. The resulting increase in flow will also tend to draw the electrolyte stream toward the area of weir 56 and so to establish metal pad 118 in that area.

At a convenient location along the trough, a feeding apparatus, schematically indicated with the downward pointing arrow 114, supplies solid feed at controlled rates to the cell 10. The trough 84 is sufficiently large to effect rapid dissolution of the feed into the electrolyte without accumulation of solids on the bottom of the trough. The feeding apparatus 114 is sealed and pressurized with inert gas.

Alternatively, liquid feed as discussed later may be utilized.

. The electrolyte flow is then directed towards the metal discharge weir 56 which is located as far as possible from semi-wall 20/22, usually at the centerline of symmetry (in plan view) of the cell, and slightly above the liquid level 116 in metal recovery compartment 18 downstream of weir 112, The separated metal is carried by the electrolyte 50 towards the weir 56 which is therefore surrounded by a metal pad 118 floating above the flowing electrolyte 50 and waiting to be discharged. In proximity to the weir 56 a metal detector 120 is positioned to detect the presence of metal floating on the electrolyte surface. Any type of metal detector or sensor can be used, but it is advantageous to use simple electric contacts, such as those used in wet bulb thermostats for the operation of domestic heating furnaces where the start/stop cycles of the furnace are activated by the contact between a mercury drop and a solid metal probe when the mercury drop moves into and out of contact with the probe by the action of the thermostat. Similarly, in the process of the present invention, the metal discharge cycles are partly controlled by the detector 120.

Preferably, the initiation of the metal discharge cycle is controlled by a clock that, at frequent intervals, starts a level rising routine, either by increasing the rate of feeding (when continuous feeding is practiced) by the feeding device 114, or by feeding inert gas into submerged open-bottom reservoir 46 shown in FIG. 1. The increased electrolyte level causes the metal to overflow into submersed closed-bottom metal recovery reservoir 54, and the floating metal pad 118 becomes smaller and smaller until the detector 120 detects the absence of metal in its location and stops and reverses the level rising cycle. Detector 120 is preferably spaced from weir 56 so that when detector 120 stops the level rising cycle, there will be some metal pad remaining adjacent weir 56 and the level will not have been raised to the point where electrolyte flows into reservoir 54. If desired for increased reliability of operation, detector 120 is provided with two electrical contacts: the first to stop the level rising routine and the second to protect from accidental mis-operation of the system. After several discharge cycles the reservoir 54 becomes full and a tapping cycle must be performed through tapping port 58 before the capacity of the crucible is exceeded. To avoid overfilling, a second metal sensor 122 is preferably installed in reservoir 54. The sensor can be of the same design as sensor 120 and its function is to send a visual or audible alarm to the operator, so that he will attend to the tapping of the cell as soon as practically possible.

Typically, the tapping cycles are performed in intervals of several hours, while the clock cycles can be set at intervals of several minutes, depending on cell productivity. The actual metal discharge time could be several seconds, depending on the level control strategy being used. The level upset during metal discharge will only introduce a small disturbance to the cell operation and its effect on average cell performance will therefore be negligible.

The flow of the electrolyte 50 is now directed downwards towards a secondary settling zone 124 in the metal compartment 18, where the small metal droplets that have not coalesced and separated at the surface are recovered before they are recycled with the electrolyte 50 to the electrolysis compartment 16. The settling zone is designed to make the electrolyte meander horizontally between baffles 66 and 68 which are uniformly spaced to provide quiet paths for the electrolyte to release its residual metal droplets towards the ceiling surfaces of the baffles. Once the metal is separated from the electrolyte 50, it is easy for it to rise towards the free surface in the metal compartment and join the floating metal pad 118. The baffles 66 and 68 can take any convenient form. Where steel plates are used, drain holes are appropriately located in the baffle plates to allow droplets to rise.

Alternative arrangements, conventionally found to be effective in enhancing coalescence, can be used for the secondary recovery of the metal droplets. For example, an array of metal channels or inverted troughs can be positioned along the electrolyte flow path, always with the view to reduce turbulence, reduce the settling distance and in general provide additional settling surfaces for the metal droplets. Such arrangements are known in the art and are extensively used for example in oil/water separation devices. Following that practice, it may be found convenient to arrange the baffles 66 and 68 as parallel plates uniformly spaced and have the electrolyte flow disposed between them in parallel streams, all directed towards the electrolysis compartment, without departing from the spirit of the invention.

In FIGS. 1 to 4 a cell design according to the invention is shown where the baffle plates 66 and 68 are in the form of arrays of pipes or tubes 70 which are used as heat exchange surfaces. This design is particularly effective in a cell 10, such as that illustrated, where the cell walls comprise a steel casing 12 lined by refractory walls 14 suitable to contain the electrolyte, as compared to cells where the electrolyte is contained in a metallic crucible that can be heated or cooled externally as the case may be. The heat exchanger 72 shown in three dimensional view in FIG. 4 is installed in the metal compartment 18 and is provided with entry and exit pipes 74 and 76 that pass through top wall/cover 109 of cell 10 and with manifolds 78. Cold air is forced through the heat exchanger 72 to cool the cell 10 to its operating temperature and, if desired, hot air can be used to boost the temperature up, according to the practice described in U.S. Pat. No. 4,420,381. The new geometry affords a more efficient heat transfer and the combination of the heat transfer function with the flow streamlining function to enhance metal coalescence is a useful part of the present invention. The entry and exit pipes 74 and 76 do not need to be insulated because they can be located away from where the metal pad 118 is usually floating, avoiding as such the problem of metal freezing in contact with the pipes.

Figure 5:
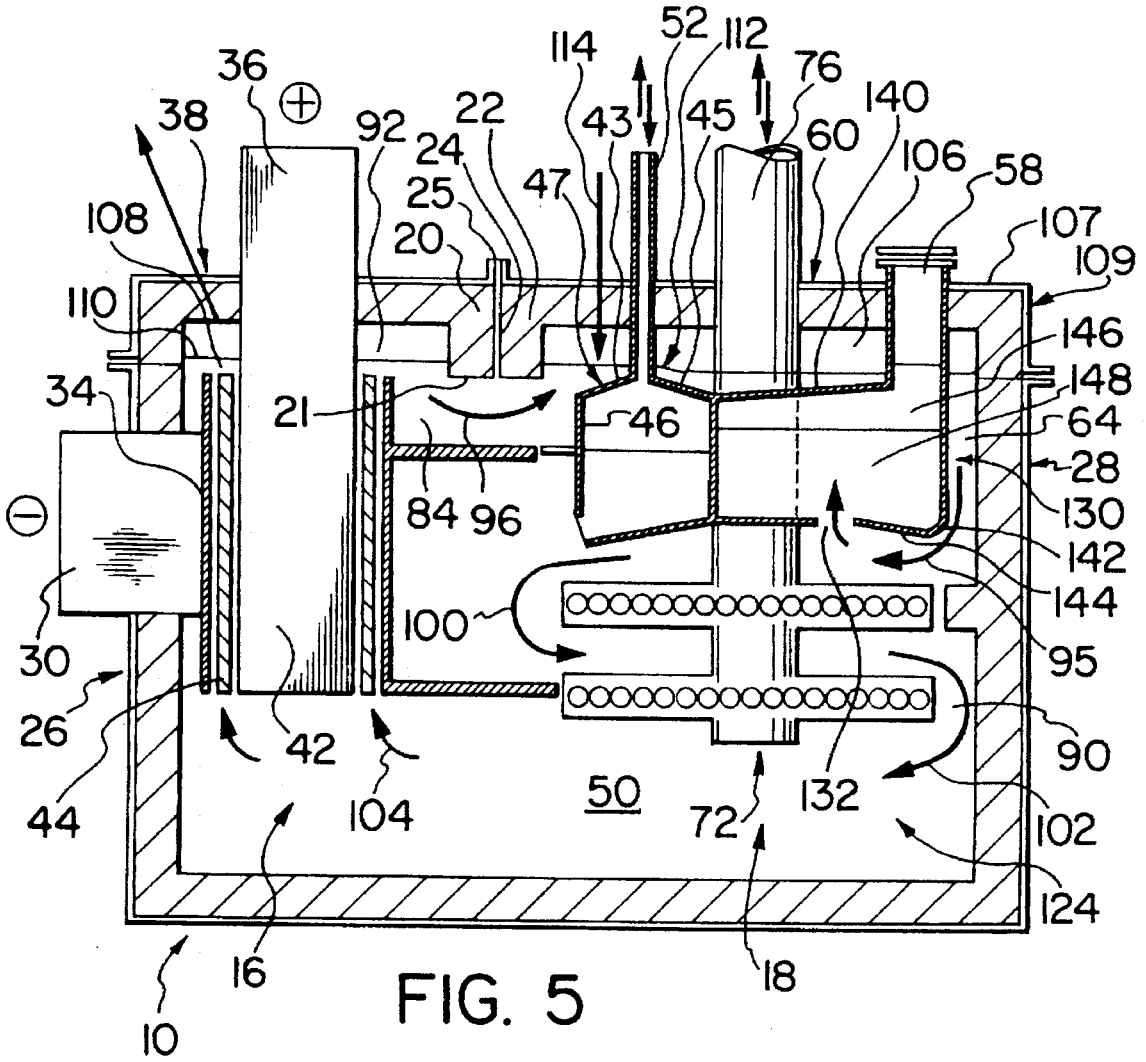
FIG. 5 is a vertical cross-section illustrating a further embodiment of the invention.

The cell shown in FIG. 5 describes an alternative embodiment of the invention, that uses a submersed open-bottom metal recovery reservoir 130 which performs the same metal storing function as reservoir 54 in the previous embodiment. This is particularly effective when the metal is only slightly less dense that the electrolyte, which is the case for example for magnesium. In this case the operating principle used for the metal collection is to sweep away the metal pad 118 that tends to form on the surface of the flowing electrolyte and drag the metal down through the space 64 between the reservoir 130 and the front wall 28 of the metal compartment 18. In this embodiment the reservoir 130 is closed at the top centre and the weir 56 is absent. Tapping port 58 is still present. The metal separates from the electrolyte below the reservoir and is collected inside the reservoir through the open bottom 132 of the reservoir 130 itself. The metal accumulates inside the reservoir and is siphoned out from it at infrequent intervals in the conventional manner through tapping port 58.

In this embodiment electrolyte flow is not encouraged to stream toward the centre front of metal compartment 18, but preferably flows evenly over reservoir 130 across its width.

To facilitate the flow of metal in the FIG. 5 embodiment, the upwardly sloped top 140 of reservoir 130 leads to increased flow velocity. Further, space 64 between reservoir 130 and front wall 28 of cell 10 is preferably reduced. Lower front edge 142 of reservoir 56 is preferably rounded and bottom wall 144 of reservoir 56 is preferably sloped upwardly toward open bottom 132 of reservoir 56. These preferred structural features all facilitate the movement of metal into the reservoir. Metal pad 146 then forms within reservoir 130 floating on electrolyte 148.

The cells shown in FIGS. 1 and 5 contain features that are desirable for intermittent feeding operations such as are used when molten feed is transported to the cell in crucibles or the like. The electrolyte volume decreases between feedings, and a compensating device in the form of a submerged open-bottom reservoir 46 is required to control the liquid level at the desired set point for optimum operation. The open-bottom reservoir 46 is supplied with controlled amounts of inert gas to compensate for electrolyte volume changes between feedings. This device is the same as provided in the prior art for the same function. The only difference is that reservoir 46 in the case of the embodiment shown in FIGS. 1 to 3 does not need to be operated during metal tappings, as in the prior art and as in the embodiment of FIG. 5. Importantly, in the present invention, reservoir 46 can be used in the embodiment of FIGS. 1 to 3 to cycle the liquid level at pre-set time intervals to effect the metal discharge into reservoir 54 as previously described.

When the cell is fed with molten feed, it is usually done by openly discharging it into the metal recovery compartment. To avoid exposure of the main electrolyte surface to ambient air which reacts with the electrolyte and metal during the feeding operations, the metal recovery compartment 18 is maintained sealed in inert gas by providing the feed port 134 with a standpipe 136 (see FIG. 2) that acts as a seal when the lid 138 is open during feeding. When the lid 138 is closed, inert gas is fed to the metal compartment 18 (to maintain its slight positive pressure) via the feed port 134, so that the standpipe 136 is filled with gas and therefore no metal accumulates inside it. For added freedom from freezing problems, the feeding port 134 is located away from the metal pad 118 floating on the electrolyte.

Thus, it is apparent that there has been provided in accordance with the invention a METHOD AND APPARATUS FOR ELECTROLYSING LIGHT METALS that fully satisfies the objects, aims and advantages set forth above. While the invention has been described in conjunction with (a) specific embodiment(s) thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim as my invention:

1. A process for the production of a molten metal by electrolysis in an electrolytic cell having an electrolysis compartment, a metal recovery compartment, and a partition separating upper parts of said compartments, said process comprising:

electrolysing in said electrolysis compartment an electrolyte containing a fused salt of said metal said salt being of greater density than said metal;

continuously withdrawing the product metal mixed with said electrolyte in a stream from said electrolysis compartment to a top part of said metal recovery compartment;

allowing said metal to form in said metal recovery compartment a pad floating on said electrolyte;

maintaining said pad out of contact with said partition; and recovering said pad.

2. The process of claim 1 wherein said step of recovering said pad comprises continuously or intermittently discharging said pad into a recovery reservoir.

3. The process of claim 2 wherein said discharging is carried out intermittently.

4. The process of claim 3, comprising initiating said discharging step by raising the level of electrolyte in said cell to cause said pad to overflow a weir into said recovery reservoir.

5. The process of claim 4 wherein said cell includes a level control reservoir for controlling the level of electrolyte in said cell and wherein said step of raising the level of electrolyte in said cell comprises the step of injecting gas into said level control reservoir to expel electrolyte from said reservoir to thereby raise said level in said cell.

6. The process of claim 2 wherein said reservoir is submersed in said electrolyte in said metal recovery compartment and includes an inlet weir extending above said electrolyte and spaced from said partition and said process further comprises directing said stream toward said inlet weir thereby to form said pad adjacent said weir.

7. The process of claim 2 wherein said reservoir is submersed in said electrolyte in said metal recovery compartment and includes an at least partially open bottom and wherein said process comprises the step of directing said stream across said recovery compartment above said reservoir, downwardly in said compartment beyond said reservoir and back under said reservoir, whereby said pad is swept under said reservoir, and allowing said pad to rise into said reservoir.

8. The process of claim 1, comprising the additional steps of directing said stream from a top part of said recovery compartment by a circuitous path downwardly through said recovery reservoir whereby additional said metal product may coalesce and float upwardly to join said pad.

9. The process of claim 8, comprising the additional steps of directing said stream from said circuitous path back toward a bottom part of said electrolysis chamber.

10. An electrolytic cell comprising:

an electrolysis compartment;

a metal recovery compartment;

a metal recovery reservoir within said recovery compartment, said reservoir being submerged in electrolyte in said cell during normal operation of said cell; and a first partition wall separating a top part of said electrolysis compartment from a top part of said recovery compartment and extending slightly below a top surface of said electrolyte in said cell during normal operation of said cell for forming a gas seal between said sections above said electrolyte and for allowing electrolyte flow between said compartments below said surface whereby a metal pad, maintained out of contact with said partition wall, is formed in said metal recovery compartment.

11. The cell of claim 10, containing a second said partition wall spaced from said first partition wall.

12. The cell of claim 11 wherein said space between said partition walls leads out of said cell and is connected to gas scrubbing apparatus.

13. The cell of claim 10, including in said metal recovery compartment a first weir extending substantially across said compartment conforming generally to the direction of said partition wall.

14. The cell of claim 13 wherein the ends of said weir are spaced from adjacent sidewalls of said cell.

15. The cell of claim 14 wherein both said faces are so sloped.

16. The cell of claim 13 wherein said weir is profiled to direct a greater proportion of flow toward and across its ends.

17. The cell of claim 13 wherein at least one of the front and back faces of said weir is gently sloped to facilitate smooth flow over said weir.

18. The cell of claim 13, including an open bottom level control reservoir in said metal recovery compartment and positioned to be immersed in electrolyte during normal operation of said cell.

19. The cell of claim 18 in which a top surface of said level control reservoir is profiled to form said weir.

20. The cell of claim 10, including a trough running the length of said first partition wall and spaced below said wall, the sides of said trough located respectively in said electrolysis compartment and said metal recovery compartment.

21. The cell of claim 20 wherein said side of said trough in said electrolysis compartment is formed in part by a cathode, said wall of said trough in said metal recovery compartment is formed by said weir and the bottom of said trough is formed by a generally horizontal partition between said cathode and said weir.

22. The cell of claim 10, including an inlet to said recovery reservoir extending to a position above the electrolyte to thereby form an inlet weir to said recovery reservoir.

23. The cell of claim 22, including a timing device for periodically activating means causing inert gas to flow into said level control reservoir during operation of said cell to raise the level of electrolyte in said cell to thereby cause metal adjacent said inlet weir to flow over said inlet weir and into said recovery reservoir.

24. The cell of claim 23 further including metal detection means adjacent said inlet weir for detecting the absence of metal adjacent said weir and responsive thereto for activating means causing inert gas to be removed from said level control reservoir to lower the level of electrolyte in said cell to prevent overflow of electrolyte into said control reservoir.

25. The cell of claim 10, including in said recovery reservoir a level sensor for sensing the level of metal in said cell during operation of said cell and for providing a signal responsive to metal reaching preselected level or levels.

26. The cell of claim 10 wherein a side of said recovery reservoir remote from said partition wall is spaced a short distance from a front wall of said cell.

27. The cell of claim 26 wherein said metal recovery compartment includes at least one baffle extending from a position adjacent a front wall of said cell to a position within said compartment to provide a circuitous path for electrolyte flow vertically in said compartment.

28. The cell of claim 27, including at least two said baffles vertically spaced from each other.

29. The cell of claim 28 wherein each said baffle is comprised of a series of heat exchanger tubes comprising part of a heat exchanger positioned in said metal recovery compartment.

30. The cell of claim 28 including at least one additional baffle which together with said baffles defines a circuitous path vertically within said metal recovery compartment.

31. The cell of claim 10 wherein said recovery reservoir has an at least partially open bottom.

32. The cell of claim 31, having a rounded lower front edge.

33. The cell of claim 31, having a part of a bottom wall sloped upwardly in a front to rear direction toward said open bottom.

* * * * *